US006823640B1

(12) United States Patent
Pytlewski

(10) Patent No.: US 6,823,640 B1
(45) Date of Patent: Nov. 30, 2004

(54) HOLLOW SPACER FOR TILES AND THE LIKE

(76) Inventor: Walter W. Pytlewski, 5171 E. Seltice Way, Post Falls, ID (US) 83854

( * ) Notice: Subject to any disclaimer, the term of this patent is extended or adjusted under 35 U.S.C. 154(b) by 59 days.

(21) Appl. No.: 10/205,176

(22) Filed: Jul. 24, 2002

(51) Int. Cl.[7] ..... G01B 5/14

(52) U.S. Cl. ..... 52/677; 52/396.1; 52/396.06; 52/747.11

(58) Field of Search ..... 52/396.1, 747.11, 52/396.07, 396.08, 396.06, 394, 396.02, 127.3, 392; 33/526, 527

(56) References Cited

U.S. PATENT DOCUMENTS

| | | | | |
|---|---|---|---|---|
| 2,031,684 A | | 2/1936 | Bercer | |
| 2,111,003 A | * | 3/1938 | Petty | 52/603 |
| 2,930,135 A | * | 3/1960 | Rodtz, Sr. | 33/518 |
| 3,276,336 A | * | 10/1966 | Crone | 404/47 |
| 3,411,257 A | | 11/1968 | Yoremchuk | |
| 3,501,877 A | | 3/1970 | White | |
| 3,745,735 A | | 7/1973 | Casano | |
| 4,300,864 A | | 11/1981 | Liebel | |
| D295,952 S | | 5/1988 | Frey | |
| 4,793,068 A | * | 12/1988 | Golkar | 33/526 |
| 4,862,668 A | | 9/1989 | De Gooyer | |
| 6,612,045 B2 | * | 9/2003 | Kruskamp | 33/526 |

FOREIGN PATENT DOCUMENTS

EP 0175014 A1 3/1926

* cited by examiner

*Primary Examiner*—Carl D. Friedman
*Assistant Examiner*—Basil Katcheves
(74) *Attorney, Agent, or Firm*—Robert Louis Finkel

(57) ABSTRACT

A family of light-weight, durable, resilient tile spacers adapted for insertion into intersecting joint spaces between tile courses, and to be left in place after the spaces have been filled with grout. Each spacer has a plurality of thin-walled hollow limbs that project radially into the intersecting joint spaces. The side walls of the limbs are compressed by the tiles on either side of the joint spaces, the amount of compression being limited by the abutment of structural elements formed on the inner faces of the side walls with stops positioned within the limbs. In one embodiment of the invention, pairs of structural elements are mounted to the limbs' respective side walls. In another, pairs of structural elements are mounted to both of the limbs' side walls. Grout figs the submerged hollow limbs during the grouting process and upon curing permanently seals and immobilizes the spacer.

13 Claims, 3 Drawing Sheets

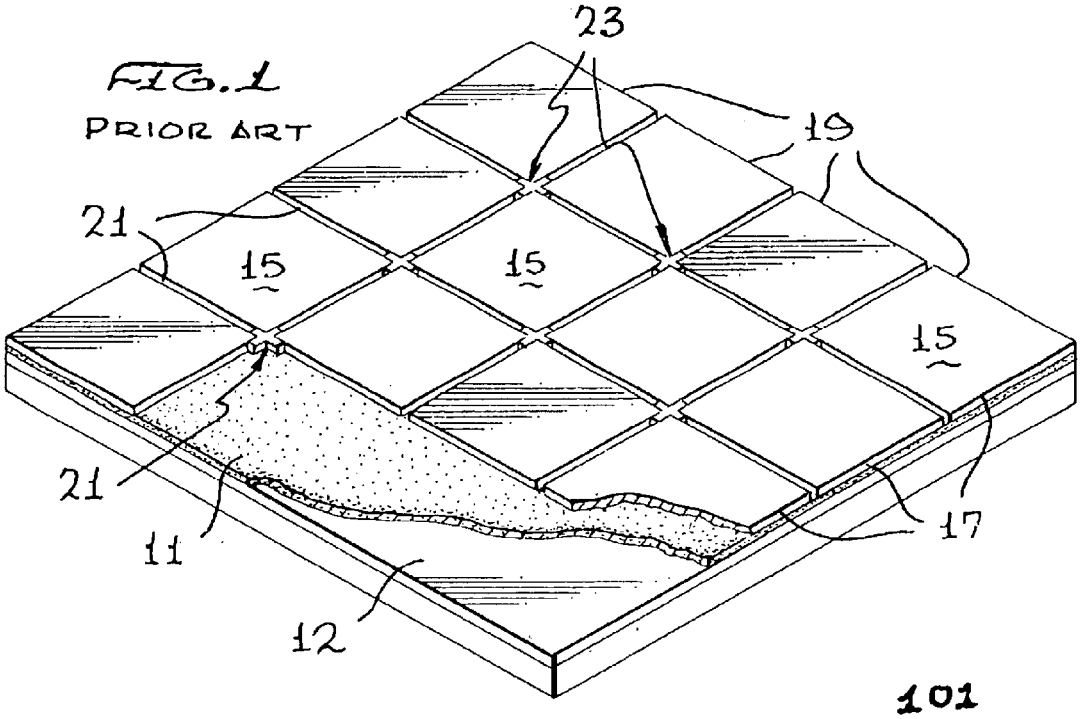
FIG. 1
PRIOR ART
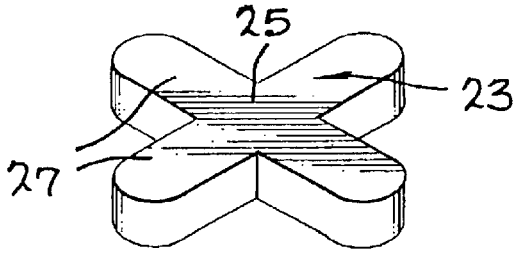
FIG. 2
PRIOR ART
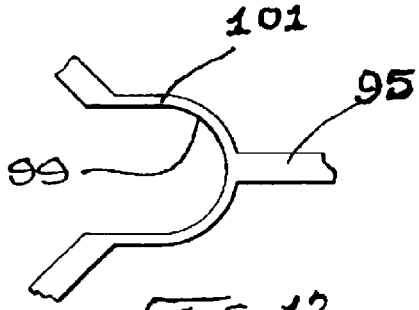
FIG. 12
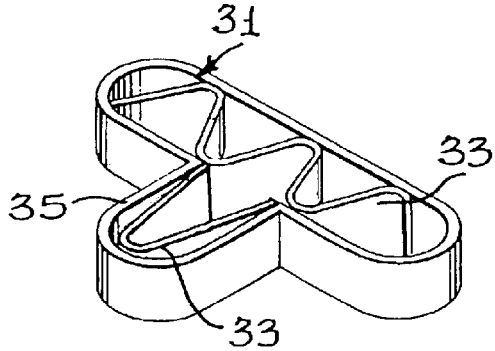
FIG. 3
PRIOR ART
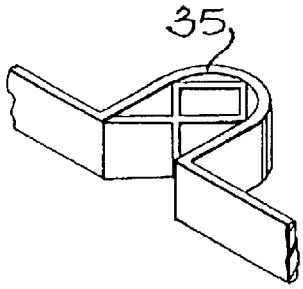
PRIOR ART
FIG. 9-A FIG. 4B
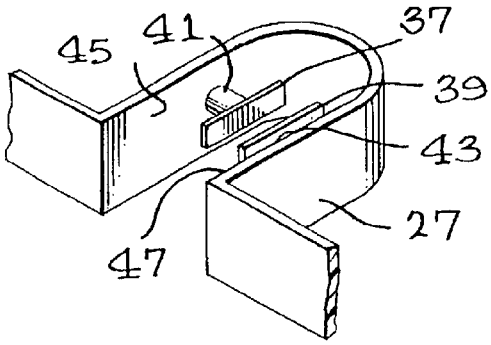
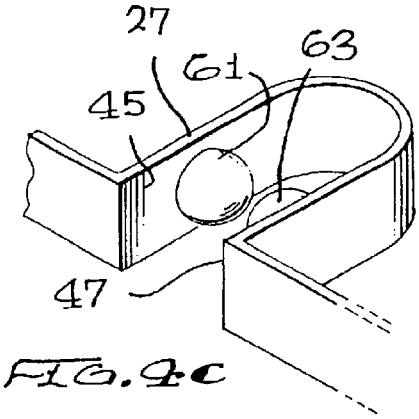
FIG. 4C
FIG. 4D
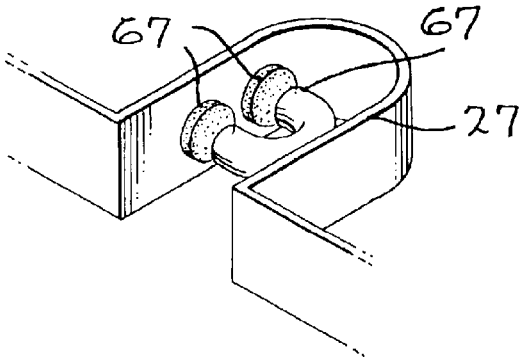
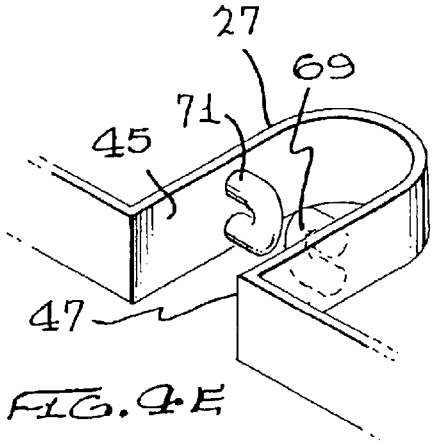
FIG. 4E
FIG. 4F
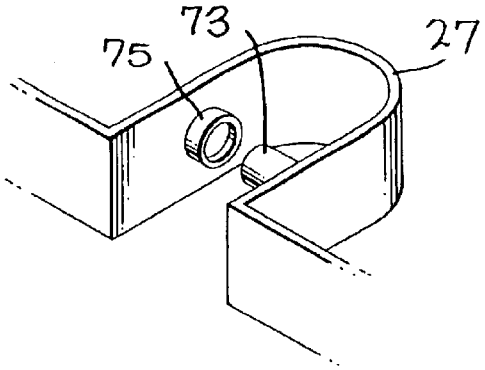
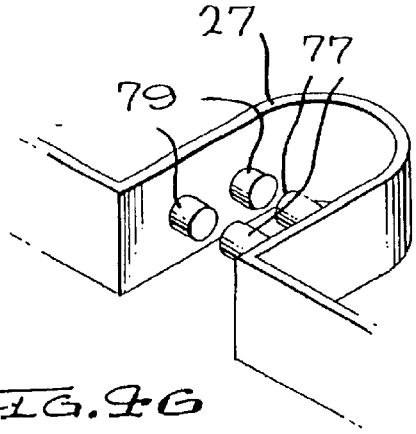
FIG. 4G FIG. 9
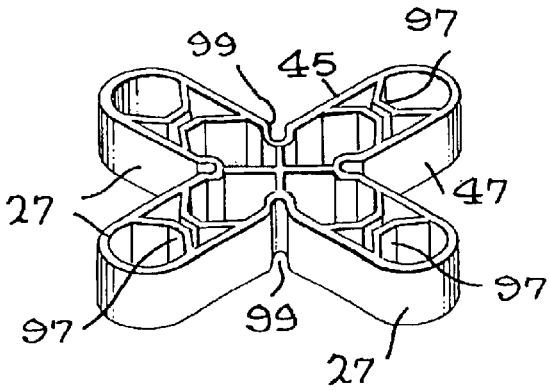
FIG. 8
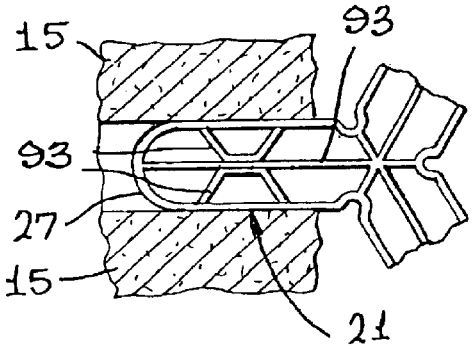
FIG. 5
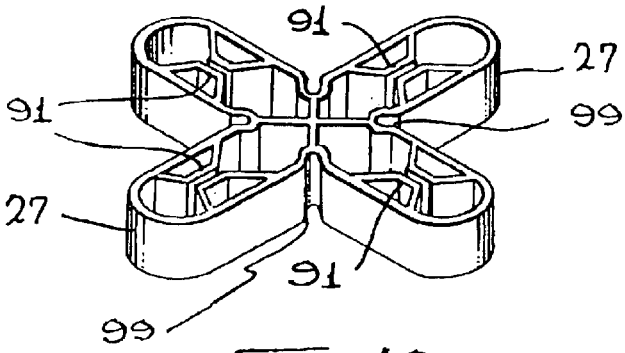
FIG. 6
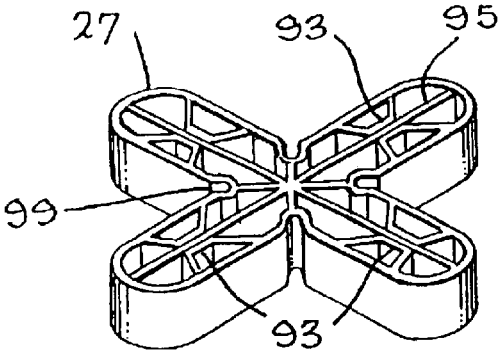
FIG. 10
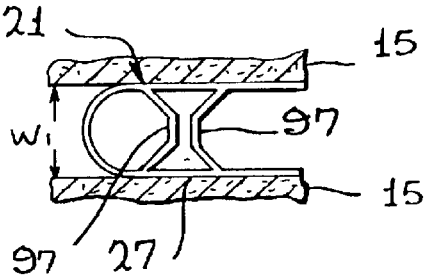
FIG. 7
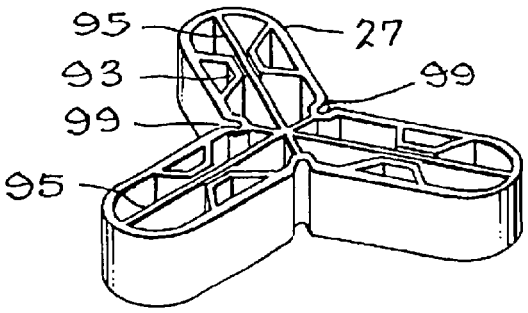
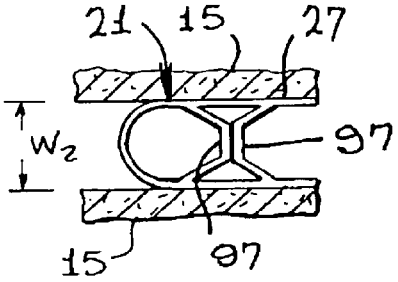
FIG. 11

HOLLOW SPACER FOR TILES AND THE LIKE

BACKGROUND OF THE INVENTION

1. Field of the Invention

The subject invention relates to spacers for creating uniform grout or mortar joints between courses of tiles and other materials, and more particularly to hollow tile spacers that are adapted to be embedded in the grout or mortar. Still more particularly, it is concerned with methods and means for constructing a family of light-weight, durable, resilient spacers for courses of tiles or the like adapted to be inserted into intersecting joint spaces between the courses, and to be left in place after the spaces have been filled with grout or mortar.

2. Prior Art

Originally considered primarily a decorative art form, ceramic tile has become a floor and wall covering of choice for residential office, commercial and even industrial installations. Increased popularity has created a growing need for ways of lowering the cost, minimizing the effort, and speeding the process of laying tile. Probably the single most expensive, labor-intensive, and time-consuming step in the tile laying operation is the manual placement of individual ceramic tiles in the courses and columns that define the chosen tile pattern. In recognition of the substantial potential savings to be made from improved tile-setting aids and methods, considerable attention has been focused on the devices and techniques employed by tile setters.

Typically, tile is set by applying a coat of cement or mastic to an underlying surface and placing the individual tile pieces side-by-side in contact with the cement or mastic material. Most commonly, adjacent tiles are spaced apart to define a more or less continuos army of grooves or joint spaces. When the cent or mastic cures the channels are filled with grout to form attractive, sealed joints. The joints contribute to the overall ornamental appearance of the ins on, prevent chipping of the tile edges, and serve to relieve forces that night otherwise cause the tiles or the grout to crack. For aesthetic effect and structural integrity, it is important tat the joints be straight and of uniform width. Historically, tile layers have employed tile spacing devices to create these joints. This invention has to do with improvements in such devices, and their use.

Tile spacers are well known in the tile setting trade. Over time, they have taken a variety of forms. Early ice employed a length of heavy cord or twine laid down between the tiles as they were being positioned. Once the cement or mastic cured, the cordage was removed and the joint cavity filled with a grout slurry. This crude technique was replaced by the use of small, solid in individual spacers made of resilient plastic materials or rubber. U.S. Pat. No. 2,031,684 illustrates a compressible rubber spacer designed to be inserted into inking or corner joint space between adjacent tees. Convincingly molded in four basic geometric plan shapes, crosses, "Vs," "Ys," and "Ts," these spacers are inserted between adjacent courses of ceramic tiles as they are cemented to a floor, counter top or wall to create and maintain channels of uniform width. The uniformity of the joints' width facilitates the tile layer's truing the joint line over the length of the adjacent tile courses.

Thinner than the ties, the solid '684 were initially left in the joint and grouted over. That practice was quickly abandoned, however, when it was discovered that some of the spacers float to the suds causing the grout to appear discolored, and worse, being resilient, causing the overlying and surrounding grout to crack and break away. Experience led to the firm conclusion that solid rubber or plastic cannot be left in the grout joint. For all of the advantages the solid spacers afforded in simplifying and facilitating the tile placing process, the requirement that they be removed prior to grouting made the installation process tedious, time consuming and expensive.

One approach to satisfying the requirement to remove the spacers resulted in the development of a variety of spacer designs adapted for easy removal from the grout joint. Another led to the provision of a number of shed tools specie adapted for prying solid spacers from grout joints. An example of a solid spacer designed for ease of removal is illustrated in U.S. Pat. No. 2,930,135. This device was larger than the '684 spacer and was irk to be removed from the joint space before grouting by means of a tool such as a screwdriver or awl or by using a specially designed hook. While somewhat enhancing the removal process, neither the improved spaces nor the hooks and prying tools effectively reduced the tedium or the time involved in the removal process.

The invention of U.S. Pat. No. 4,862,668 was intended to provide an alternative to manually removed sacs such as the '684 and '135 devices. This spacer is made of a solid, semi-rigid, foamed polymeric material adapted to be melted and burned with a flame from a torch after the mastic or cement is cured. Aside from the danger of personal injury and property damage inherent in the use of fire on a jobsite, the removal of the '668 spacer is still labor intensive and slow.

It has long been recognized by those skilled in the art that there is an unfilled need for a resilient spacer that does not have to be removed or destroyed before grouting and that can be left permanently imbedded in the grout or mortar joint without long-term undesirable results. A number of alternatives to the solid rubber or plastic spacer have been proposed in attempts to fill that need. None of these is entirely suitable for the intended purpose, and none effectively lowers the cost, the effort, or speeds the process of laying tile. By way of several examples, U.S. Pat. No. 3,411,257 discloses a family of rigid hollow sheet met and open mesh spaces adapted for insertion into the mortar between courses of bricks. U.S. Pat. No. 3,501,877 shows a V-shaped metal masonry joint spacer having openings allowing mortar to pass through the spacer U.S. Pat. No. 3,745,735 teaches a tile-spacer fabricated from a metal strip and adapted to allow grout to enter and cure the spacer body. These alternative constructions suffer from a multitude of deficiencies. Most significantly, none of them affords the tile setter the resiliency and flexibility required for making the repeated fine adjusts to the age and spacing of the grout joint while the ties are being positioned.

OBJECTS OF THE INVENTION

Given the state of the prior art, one of the objects of the subject invention is the provision of a family of lightweight, durable, resilient tile spacers adapted for insertion into intersecting joint spaces between tile courses, and to be left in place after the spaces have been filled with grout.

A second object of the invention is to provide spacers having the aforementioned characteristics that neither suffer nor cause any undesirable results when they are immersed in grout and left in place after the grout cures. In particular, the subject tile spacer must not cause discoloration or cracking and faking of the cured grout.

The subject invention reflects a perceived need for and has for another of its objects the provision of a durable, resilient, weight tile spacer that is inexpensive to manufacture, and requires a minimum of skill, time and effort to use.

Another object of the invention is the provision of an improved tile spacer of the type described here that avoids or overcomes the various defects and deficiencies of the prior art spacers.

Still another object is the provision of a tile spacer constriction capable of being incorporated in spacers of all of the basic configurations needed for residential, office, commercial and industrial tile installations.

Yet another object is the provision of a family of novel tile spacers and methods and means for producing and utilizing them for facilitating the laying of tile with uniform and accurately aligned grout joints

SUMMARY OF THE INVENTION

The subject invention comprises a family of light-weight, durable, resilient tile spacers adapted for insertion into intersecting joint spaces between tile courses and to be left in place after the spaces have been filled with grout. Each spacer has a plurality of hollow, preferably generally race track-shaped limbs that project radially into the intersecting joint spaces. The side walls of the limbs are compressed by the tiles forming the joint spaces, the amount of compression being limited by the abutment of structural elements formed on the confronting inner faces of the side walls with stops positioned within the limbs. In one embodiment of the invention, a pair of structural elements are mounted to the confronting faces of respective side walls and abut one another or an intervening structural element. In another, each structural element is mounted to both of the side walls and the structural elements abut one another or an intervening stop.

The top and bottom of the spacer are open, and the structural elements and stops occupy a minimal amount of space within the limbs, leaving a substantial cavity effectively extending the length and width of the spacer. In inserting the spacers in the joint spaces, the tile layer need only take care to position them below what will be the level of the surface of the grout in the filled joint. During the grouting process, the watery grout slurry fills the submerged cavities in the limbs and upon hardening and curing permanently seals and immobilizes the spacers.

In addition to those mentioned above, other objects, features, advantages, and applications of the invention will become apparent from the following detailed description of the construction and operation of what are presently considered to be its preferred embodiments. Throughout the description, reference is made to the accompanying Drawing, in which:

BRIEF DESCRIPTION OF THE DRAWING

FIG. 1 is a top perspective view of a typical prior art tile installation illustrating the use of spacers to separate the rows and columns of tiles;

FIG. 2 is the top perspective view of a typical prior art cruciform spacer made of rubber;

FIG. 3 is a top perspective view of a fanciful hollow prior art spacer incorporating a wave-type compression element to maintain its structural integrity;

FIG. 4A is a fragmentary top perspective view of another fanciful hollow prior art spacer incorporating a corrugated compression element to maintain its structural integrity;

FIGS. 4B–4G are fragmentary top perspective views of portions of representative examples of spacers embodying the subject invention illustrating a variety of structural elements and motion-limiting stops positioned in one of the spacer limbs;

FIG. 5 is a top perspective view of a spacer in accordance with the subject invention wherein the structural elements are mounted to the respective side walls of the spacer limb;

FIG. 6 is a top perspective view of an embodiment similar in construction to the embodiment of FIG. 5, wherein the spacer has three limbs;

FIG. 7 is a fragmentary section through a portion of one of the limbs of the spacer illustrated in FIG. 6 with the side walls of the limb relaxed;

FIG. 8 is a fragmentary section through a portion of one of the limbs of the spacer illustrated in FIG. 6 with the side walls of the limb under compression;

FIG. 9 is a top perspective view of a spacer in accordance with the subject invention wherein the structural elements are mounted to both of the side walls of the limbs;

FIG. 10 is a fragmentary section through one of the limbs of the embodiment of FIG. 9 with the side walls of the limb relaxed;

FIG. 11 is a fragmentary section through one of the limbs of the embodiment of FIG. 9 with the side walls of the limb under compression; and FIG. 12 is an enlarged fragmentary detail showing the reduced thickness of the side walls of a typical limb in the region of one of the compression-facilitating indentations.

Wherever practicable, like numerals are employed to designate like or functionally equivalent parts in the several figures.

DETAILED DESCRIPTION OF THE PREFERRED EMBODIMENTS

Referring to FIG. 1, a coat of cement, mastic or other suitable adhesive material 11 is applied to an underlying concrete or composition board surface 12. Individual ceramic tiles 15 are placed side-by-side in contact with the adhesive material 11 to define rows 17 and columns 19. The adjacent tiles 15 are spaced apart to define a gridwork of grooves, referred to here descriptively as joint spaces 21. To aid the tile layer in making the joint spaces 21 straight and of uniform width, it is conventional practice to employ tile spaces 23 such as the one illustrated in FIG. 2.

To accommodate the most common patterns, spacers 23 are molded in four basic geometric shapes, to-wit, crosses such as the one shown in FIG. 2, "Vs," "Ys," and "Ts". Most frequently, these are molded of rubber or a suitable resilient plastic material.

The spacer 23 is essentially a body 25 with a plurality of limbs 27 extending radially outward from it. Generally, the thickness of the spacer 23 is less than that of the tiles 15 with which it is intended to be used.

Typically, a first course of tile 15 is applied to the adhesive layer 11 along a wall or some other convenient structural feature. As each tile 15 is set down, a pair of spacers 23 is placed at its corners and the next tile set and brought into contact with the spacers' intervening limbs 27. Moving the second tile 15 toward the first compresses the limbs 27 of spacers 23. Adjusting the second tile 15 until the resistance exerted by the limbs 27 of spacers 23 is equal, the artisan is assured that joint space 21 between the tiles 15 is of uniform width. Placing two more spacers 23 at the corners of the second tile and repeating the placement and adjustment procedure creates a second joint space 21 of the same width as the first. In similar fashion, tile after tile is laid down with assurance that all of the joint spaces 21 will be uniform and of equal width.

In similar fashion, a second course of tiles 15 is applied to the adhesive coating 11 and brought into contact with the spacers 23 at the corners of the first course of tiles 15 with the limbs 27 of spacers 23 extending into the joint spaces 21 between successive courses. In this manner, rows 17 and columns 19 of tiles 15 are secured to the underlying surface 13 with the joint spaces 21 separating them straight and uniform.

When the tiles 15 have all been placed and the adhesive coat 11 has thoroughly dried, spaces 21 are filled with grout to provide an attractive, water tight seal to the installation.

Previously, before the grout could be applied, all of the spacers 23 had to be removed lest they lead to the discoloring, and ultimately the cracking and faking, of the grout surrounding and covering them. Even with specialty made hooks and prying tools this task, normally carried out manually, is tedious, time-consuming and costly. If a spacer could be made that did not have to be removed and that could remain in the joint spaces 21 without discoloration and deterioration of the grout, substantial savings could be effected.

When efforts to achieve the desired results using fabricated metal spacers proved unsuccessful, interest turned to the possibility of providing a useable hollow molded plastic spacer. FIG. 3 illustrates one possible construction for a hollow spacer 31 using a sinuous web 33 of plastic material to provide the required degree of support and resistance to the thin encircling spacer wall 35. Molding such devices and achieving the degree of compressive uniformity posted insurmountable challenges. The use of alternative forms of compressible internal structures, such as the corrugations shown in FIG. 4A, likewise suffered from a number of unacceptable deficiencies.

The subject invention represents a radical departure from the approach taken by the illustrated exemplars. Rather than employing the compressibility of an interior mass to provide resilient support for the walls of a hollow spacer, as depicted in FIGS. 3 and 4*a*; the subject invention provides within the cavity of the spacer an internal structure associated with at least one of the moveable walls of the spacer limb and motion-limiting stop means that physically arrest the movement of the internal structure upon compression of the spacer walls. Typical examples of such internal structures and motion-limiting stops that operate in conjunction with them are illustrated in FIGS. 4B–4G. These samples are not intended to be exhaustive, and it will be understood that the invention encompasses a variety of suitable alternative structures and constructions that will serve the purpose in the manner illustrated by the exemplars.

In the embodiment of FIG. 4B, a pair of plates 37, 39 mounted to standoffs 41, 43 attached to opposing inner walls 45, 47 of the limb 27 serve interchangeably as structural elements and motion-limiting stops.

In the embodiment of FIG. 4C; a pair of protuberances 61, 63 formed on the confronting walls 45, 47 of limb 27 serve alternatively as moveable structural elements and motion-limiting stops. In FIG. 4D; a stirrup 65 mounted to one of the inner walls of the limb 27 is adapted to strike a pair of resilient pads 67 positioned on the opposite inner wall when the walls of the limb are compressed. In FIG. 4E, a similar result is achieved by mounting a pair of stirrups 69, 71 to the respective walls 45, 47 of limb 27 in a manner such that one serves as a motion-limiting stop to the other upon compression of the walls of limb 27.

FIG. 4F shows yet another embodiment of the principle of employing a structural element and stop means to limit the compression of the spacer limb walls. Here, the structural element takes the form of an elongated upstanding probe 73 mounted on one of the walls, and a receptacle 75 mounted in registry with the probe on the other of the walls.

FIG. 4G depicts the use of opposed pairs of confronting bumpers 77, 79 mounted to the respective side walls of the limb 27.

FIGS. 5–8 illustrate embodiments of the invention incorporating structures of the type exemplified by the embodiments of FIGS. 4B–4G.

FIGS. 9–11 illustrate an alternative embodiment of the invention which, though reliant on the same principle as the embodiments of FIGS. 5–8, utilizes a related but distinguishable construction.

Referring to FIGS. 5–8, a hollow spacer in accordance with the invention (shown here in variants having three or four limbs but equally applicable to spacers of other shapes) is formed, preferably by injection molding, of a resilient plastic material such as ethyl vinyl acetate, polypropylene, polyethylene, or the like, capable of providing a predictable preload char to the internal structure of the spacer. In the spacers of FIGS. 5–8, structural elements 91, which may be of any suitable design, but here are illustrated in the form of trapezoidal webs, are mounted to one or the other of the opposing interior walls of the limbs 27. The walls and internal structure of the spacer are from about 0.030 to about 0.037 inch, and preferably about 0.035 inch thick In the embodiment of FIG. 5, compression of the side walls of the limbs 27 forces the adjacent faces of elements 91 toward one another and ultimately into motion-limiting contact with one another. Through the use of well-known design technology, the compressive resistance and point of contact of elements 91 can be predetermined with considerable accuracy to provide spaces adaptable for any desired tiling application.

In the embodiments of FIGS. 6–8, the structural elements 93 are, as in the embodiment of FIG. 5, mounted to the respective side walls of each limb. For structural purposes having nothing to do with the invention, however, in this embodiment additional support is provided to the spacer body and the respective limbs by axial webs 95 interposed between the structural elements 93. In this instance, the motion of each of the structural elements 93 is limited by its impingement with its associated web 95. The web 95 thus acts as a motion-limiting stop.

FIG. 8 illustrates the position of the components of one of the limbs 27 of the embodiment of FIG. 7 at the point of maximum allowable compression between the tiles 15 on opposite sides of a joint space 21. Spacers embodying the subject invention will be manufactured in a series of sizes, such that the spacing between the outer faces of the side walls at the point of maximum allowable compression will be the typical conventional joint widths used in most commercial tile installations, namely, ¼", ⅜", ½", and ¾. Because the compressibility of the subject spacer is determined by the precise placement of the structural elements and the motion limiting stops, rather than by the compressibility of the mass of the limb itself as in the prior art solid spacers, spacers can now be produced with virtually any desired joint width, for example, ⅝", ⅞", 1" or larger, in mind.

In the embodiment illustrated in FIGS. 9–11, the structural elements in each of the limbs 27 take the form a structural web 97 mounted transverse to the limb and attached at its ends to the opposite sides of the limb 27. The webs 97 are designed to be resiliently flexible so as to be urged toward one another by the compression of the side walls 45 and 47 of the limb 27. As best seen in FIGS. 10 and 11, these webs 97 are formed with a permanent bow in the direction of one another whereby compression of the side walls of the limbs 27 urges the two webs in the limb toward one another. As depicted in FIG. 10, while the space $W_1$ between the tiles on opposite sides of the joint space 21 is greater than the desired joint width $W_2$, the webs 97 are spaced apart and further compression is possible. When the force exerted by the tiles on opposite sides of the joint space 21 compresses the joint space width to the predetermined width $W_2$, the webs 97 come into abutment, and further compression of the limb and narrowing of the joint space are prevented. It will be observed that in each of the embodiments illustrated and described, the compressibility and ultimate width of the limbs of each of the spacers embodying the invention can be determined with considerable accuracy and reliable repeatability.

The interior of each of the embodiments of the spacer is essentially a cavity or cavities surrounded by a thin but sturdy wall and open at its top and bottom. The height of the spacer wall that is, the spacer thickness, is less than the thickness of the ceramic tiles with which it is used. During the installation process, inserting the spacer into the joint space in contact with the underlying surface or tamping it into the joint space insures that its upper surface will be below the surface of the grout in the joint space. As a consequence of the spacer's open construction, during the grouting process the grout slurry flows into the interior cavities of the spacer and hardens and cures there at the same time as the grout hardens and cures in the remainder of the joint spaces. The grout within the spacer cavities thus becomes an integral part of the grout mass surrounding the spacer, and what little if any resilience is retained by the fully encapsulated spacer material has no affect on the joint.

It will be noted, further, that in the solid prior art spacer depicted in FIG. 2, the side walls of the limbs 27 are parallel through their entire lengths and meet at right angles at their respective intersections. This construction is permissible because the relatively small deformation of the portion of the sides adjacent the intersections has little effect on the overall width or linearity of the solid limbs 27. The thin-walled construction of the limbs 27 in the subject invention, however, is less forgiving. Accordingly, as best seen in FIG. 12, I have found it advantageous to compensate for the transverse movement of the side walls 45, 47 by providing indentations 99 at the intersections of the side walls with the body of the respective embodiments of the invention. These indentations 99 facilitate the compression of the side walls 45, 47 and allow them to remain in essentially parallel relationship while they are being compressed by the adjacent opposed tiles. To further enhance the compression of the limbs, I find it preferable to reduce the thickness of the walls 45, 47 in the region 101 of the indentations, thereby affording the side walls 45, 47 even greater flexibility than is provided by the indentations 99 alone.

By virtue of the foregoing design and construction features, the subject invention provides substantial advantages over the prior art spacers. Its open, light-weight construction uses far less material than the typical solid spacer of similar configuration. In operation, it is as effective as or more effective than any of the prior art devices in spacing and aligning ceramic tiles and the like. Unlike any of the prior art spacers, it need not be removed prior to grouting, and it may safely be retained in the joint spaces even after grouting without the danger of discoloration or flaking of the surrounding or overlying grout.

The utility and benefits afforded by the invention will be readily apparent from the foregoing disclosure. It should be understood, however, that although the invention has been disclosed in terms of the specific constructions shown in the drawing and described in the text, it is not to be construed as limbed to those embodiments. They are to be regarded as illustrative rather than restrictive. This specification is intended to encompass any and all variations, alternative forms, and equivalents of the examples chosen for purposes of the disclosure, which do not depart from the spirit and scope of the invention as it is defined by the following claims.

What is claimed is:

1. A tile spacer adapted for insertion into intersecting joint spaces between adjacent tiles, comprising:

a body having a plurality of hollow limbs projecting radially into the joint spaces, the limbs having a pair of spaced, substantially parallel, resilient side walls generally of substantially uniform thickness, the thickness of the side walls in the region adjacent said body being reduced, the side walls being compressible by pressing together the tiles forming the joint spaces;

first structural elements positioned within the limbs in association with the side walls; and motion-limiting stops positioned within the limbs in registry with said first structural elements, said first structural elements being brought into abutment with said stops by compression of the side walls.

2. The tile spacer of claim 1, wherein the side walls in the region adjacent said body are indented.

3. The tile spacer of claim 2, wherein the tile spacer is molded of ethyl vinyl acetate.

4. The tile spacer of claim 2, wherein the tile spacer is molded of polypropylene.

5. The tile spacer of claim 2, wherein the tile spacer is molded of polyethylene.

6. The, tile spacer of claim 2, wherein said motion-limiting stops comprise second structural elements positioned within the limbs in association with the side walls, each of said first and second structural elements being associated with only one side wall of a limb.

7. The tile spacer of claim 2, comprising second structural elements positioned within the limbs in association with the side walls, each of said first and second structural elements being associated with only one side wall of a limb, said motion-limiting stops being positioned intermediate and in registry with said first and second structural elements, said first and second structural elements being brought into abutment with said stops under force exerted by the tiles forming the joint spaces.

8. The tile spacer of claim 2, wherein said motion-limiting stops comprise second structural elements positioned within the limbs in association with the side walls, each of said first and second structural elements being associated with both side walls of a limb.

9. The tile spacer of claim 8, wherein said first and second structural elements comprise resiliently flexible webs, said webs being normally bowed toward one another.

10. A tile installation, comprising:

a plurality of tiles arranged to form intersecting joint spaces; and a plurality of tile spacers inserted into the joint spaces at their intersections, said tile spacers having hollow limbs projecting radially into the joint spaces, the limbs comprising:

pairs of spaced, substantially parallel, resilient side walls defining cavities having open tops and bottoms, said side walls being generally of substantially uniform thickness, their thickness in the region adjacent said body being reduced, and being indented in the region adjacent said body;

first structural elements positioned within the limbs in association with the side walls; and motion-limiting stops positioned within the limbs in registry with said first structural elements, said first structural elements having been brought into abutment with said stops under force exerted by the tiles forming the joint spaces;

the joint spaces and cavities being substantially filled with grout, the grout having hardened and cured with the spacer embedded in the joint space.

11. The tile installation of claim 10, wherein said motion-limiting stops comprise second structural elements positioned within the limbs in association with the side walls, each of said first and second structural elements being associated with only one side wall of a limb.

12. The tile installation of claim 10, comprising second structural elements positioned within the limbs in association with the side walls, each of said first and second structural elements being associated with only one side wall of a limb, said motion-limiting stops being positioned intermediate and in registry with said first and second structural elements, said first and second structural elements having been brought into abutments with said tops under force exerted by the tiles forming the joint spaces.

13. The tile installation of claim 10, wherein said motion-limiting limiting stops comprise second structural elements positioned within the limbs in association with the side walls, each of said first and second structural elements being associated with both side walls of its limb.

* * * * *